United States Patent [19]

Spehrley, Jr.

[11] 4,449,661

[45] May 22, 1984

[54] STAPLING APPARATUS

[75] Inventor: C. W. Spehrley, Jr., Quechee, Vt.

[73] Assignee: Xerox Corporation, Stamford, Conn.

[21] Appl. No.: 535,551

[22] Filed: Sep. 28, 1983

Related U.S. Application Data

[63] Continuation-in-part of Ser. No. 427,388, Sep. 29, 1982, abandoned, which is a continuation of Ser. No. 907,646, May 22, 1978, abandoned.

[51] Int. Cl.[3] ..... B27F 7/19; B27F 7/36

[52] U.S. Cl. ..... 227/155; 227/131

[58] Field of Search ..... 227/19, 77, 108, 155, 227/131

[56] References Cited

U.S. PATENT DOCUMENTS

| | | | |
|---|---|---|---|
| 496,634 | 5/1893 | Bradley et al. | 227/155 X |
| 1,094,588 | 4/1914 | O'Brien | 227/155 X |
| 1,111,114 | 9/1914 | Weber | 227/155 |
| 1,773,823 | 8/1930 | Polzer | 227/155 |
| 1,807,170 | 5/1931 | Peterson | 227/155 X |
| 3,474,947 | 10/1969 | Readyhough | 227/7 |
| 3,971,969 | 7/1976 | Wines et al. | 310/30 |
| 4,030,656 | 6/1977 | Gordon | 227/131 |
| 4,032,228 | 6/1977 | Whited | 271/258 |
| 4,033,500 | 7/1977 | Manganaro | 227/131 |
| 4,076,408 | 2/1978 | Reid et al. | 271/258 X |

*Primary Examiner*—Paul A. Bell

*Attorney, Agent, or Firm*—H. Fleischer; J. E. Beck; R. Zibelli

[57] ABSTRACT

A solenoid powered apparatus for clenching staples is disclosed. The known force-displacement output of the solenoid is converted to match the known force required to clench the staple legs.

12 Claims, 3 Drawing Figures

STAPLING APPARATUS

This is a continuation-in-part of application Ser. No. 427,388, filed Sept. 29, 1982, now abandoned which is a continuation of Ser. No. 907,646, filed May 22, 1978, now abandoned.

BACKGROUND OF THE INVENTION

This invention relates to an electrophotographic printing machine, and more particularly concerns an improved stapling apparatus for use therein.

In the process of electrophotographic printing, a photoconductive member is charged to a substantially uniform level, thereby sensitizing the surface thereof. Thereafter, the charged photoconductive member is exposed to a light image of an original document being reproduced. Exposure of the charged photoconductive surface discharges the charge selectively in the irradiated area. This records an electrostatic latent image on the photoconductive surface corresponding to the informational areas contained within the original document being reproduced. After the electrostatic latent image is recorded on the photoconductive surface, the latent image is developed by bringing a developer mix into contact therewith. The greater attractive force of the latent image causes toner particles to be attracted from the carrier granules of the developer mix to the latent image. Thereafter, the resultant toner powder image is transferred to a copy sheet and permanently affixed thereto. This general approach was originally disclosed by Carlson in U.S. Pat. No. 2,297,691, and has been further amplified and described by many related patents in the art.

Frequently, it is highly desirable to reproduce a set of original documents as a plurality of sets of copies. This may be accomplished by employing a recirculated document handling system in association with the electrophotographic printing machine. The recirculating document handling system is positioned on the platen of the printing machine and advances successive original documents thereto. The original documents disposed on the platen are exposed and subsequently reproduced. After being copied, each original document is returned to the stack of original documents so that it may be re-imaged for the next successive copying cycle. In this manner, collated sets of copies or booklets may be formed. Each set of copies corresponds to the set of original documents. The copy sheets of specific booklets are stapled to one another.

A stapling apparatus is located at the finishing station of the printing machine to staple the set of copies. After the staple has been driven through the set of copies, the legs thereof protrude outwardly therefrom. Thus, it is necessary to bend the legs back into contact with the set of sheets, i.e. to clinch the legs. This may be readily achieved by a clinching mechanism. Various types of techniques may be utilized to achieve clinching. For example, a passive clincher employs an anvil having an appropriately configured groove into which the legs of the staple are pressed. This bends the legs into contact with the sheets. Active systems utilize clincher ears which move from a position spaced from the legs to a position in engagement therewith so as to fold the legs into contact with the bottom most sheet of the set. Hereinbefore, active clinching mechanisms have been driven by pneumatic, hydraulic, mechanical and electromagnetic devices. In clinching mechanisms previously employed, the electromagnetic device must be far larger than is optimum in order to provide the maximum force required over the range of displacement. This is due to the fact that electromagnetic devices, such as solenoids, produce very little force when their cores are extended, thus, they generally develop insufficient force to start the clinching operation when the output force thereof matches the required force to complete the clinching operation.

When a solenoid is selected which develops sufficient force to start clinching operation, the resultant output force produced by the solenoid armature is greater than required to complete clinching of the staple legs. This is due to the fact that at the start of clinching, the core, i.e. armature of the solenoid is fully extended. At completion of clinching the core extension is a minimum. Thus, the force applied by the armature increases as the clinching operation proceeds.

Accordingly, it is the primary object of the present invention to improve the clinching mechanism employed in a stapling apparatus.

PRIOR ART STATEMENT

Various types of devices have hereinbefore been developed to improve stapling machines. The following prior art appears to be relevant: Readyhough U.S. Pat. No. 3,474,947 Oct. 20, 1969, Wines et al. U.S. Pat. No. 3,971,969 July 27, 1976, Gordon U.S. Pat. No. 4,030,656 June 21, 1977, Manganaro U.S. Pat. No. 4,033,500 July 5, 1977.

The pertinent portions of the foregoing prior art may be briefly summarized as follows:

Readyhough discloses a pneumatically actuated clinching mechanism.

Wines et al. describes an electrically operated stapling device where staples are driven into the article to be stapled by a driver blade powered by a solenoid.

Gordon discloses a stapling apparatus employing a pair of solenoids to obtain different magnitude forces.

Manganaro describes a trigger actuated electromagnetic stapler.

It is believed that the scope of the present invention, as defined by the appended claims, is clearly patentable distinguishable over the foregoing prior art taken either singly or in combination with one another.

SUMMARY OF THE INVENTION

Briefly stated, and in accordance with the present invention, there is provided an apparatus for stapling articles.

Pursuant to the features of the invention, the apparatus includes means for driving a staple through the article so that a portion of the staple legs extend therethrough. Means are provided for bending the portion of the staple legs protruding through the articles into substantial contact therewith. In this manner, the staple is clinched. Means apply a force on the bending means which varies as a function of the distance of movement of the bending means. The bending means exerts a clinching force on the legs of the staples which varies as a function of the distance of movement thereof in substantially the same manner as the force applied thereon by the applying means.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
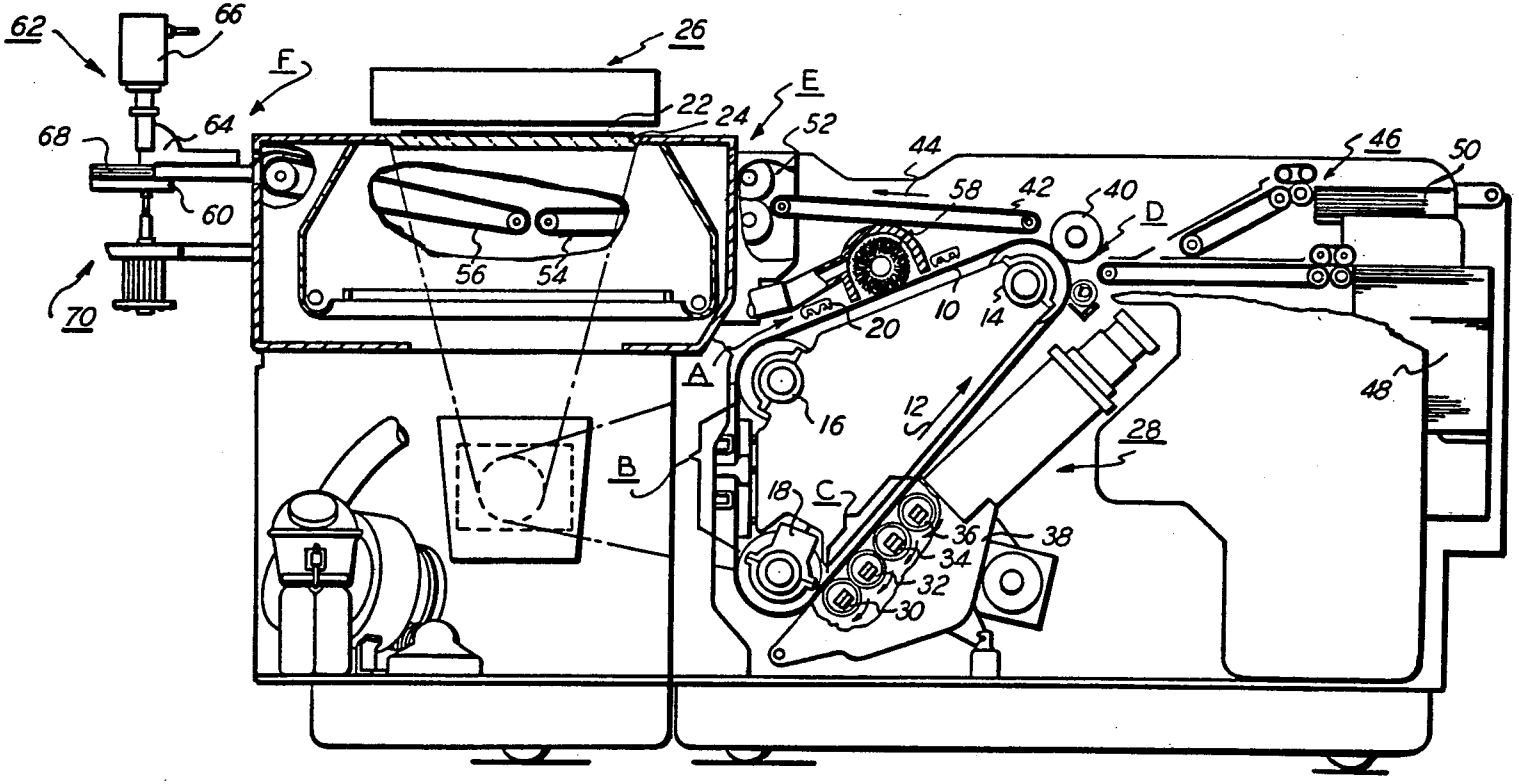
FIG. 1 is a schematic elevational view of an electrophotographic printing machine incorporating the features of the present invention therein.

In order to more fully understand the electrophotographic printing machine incorporating the features of the present invention therein, reference is made to the drawings. In the drawings, like reference numerals have been used throughout to designate identical elements. FIG. 1 schematically illustrates the various components of an electrophotographic printing machine incorporating the stapling apparatus of the present invention therein. Although the improved stapling apparatus is particularly well adapted for use in an electrophotographic printing machine, it will become evident from the following discussion that it is equally well suited for use in a wide variety of machines and is not necessarily limited in this application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface, e.g. made from a selenium alloy, deposited on a conductive substrate, e.g. aluminum. As shown in FIG. 1, belt 10 moves in the direction of arrow 12 to advance sequentially through the various processing stations positioned about the path of movement thereof. Rollers 14, 16 and 18 support belt 10. A drive mechanism, i.e. a suitable motor, is coupled to roller 14 and advances belt 10 in the direction of arrow 12.

Initially, a portion of the photoconductive surface of belt 10 passes through charging station A. Preferably, charging station A includes a corona generating device, indicated generally by the reference numeral 20, which charges the photoconductive surface of belt 10 to a relatively high substantially uniform potential. A suitable corona generating device is described in U.S. Pat. No. 2,836,725, issued to Vyverberg in 1958.

Next, the charged portion of the photoconductive surface of belt 10 advances through exposure station B. At exposure station B, a recirculating document handling system indicated generally by the reference numeral 26, presents successive original documents 22, one at a time, to exposure station platen 24 and returns the original documents to the stack thereof. After the original document is exposed, it is returned to the stack of original documents. A suitable recirculating document handling system is described in U.S. Pat. No. 4,076,408, issued to Reid et al. in 1978, the relevant portions thereof being hereby incorporated into the present application. Original document 22 is positioned face down upon platen 24 and a lamp flashes light rays thereon. The light rays reflected from original document 22 are transmitted through the optics of the exposure system forming a light image containing the informational areas of the original document therein. The optics, e.g. a suitable lens and mirror, project the light image onto the charged portion of the photoconductive surface of belt 10. In this manner, the charged portion of the photoconductive surface is discharged selectively by the light image of the original document. This records an electrostatic latent image on the photoconductive surface which corresponds to the informational areas contained within original document 22.

Thereafter belt 10 advances the electrostatic latent image recorded thereon to development station C. Development station C includes a developer unit 28 having a plurality of magnetic brush developer rollers 30, 32, 34 and 36 disposed in housing 38. Each developer roller advances the developer mix into contact with the electrostatic latent image recorded on the photoconductive surface of belt 10. In a system of this type, a chain-like array of developer mix extends in an outwardly direction from each developer roller to contact the electrostatic latent image recorded on the photoconductive surface. The latent image attracts the toner particles from the carrier granules forming a toner powder image on belt 10.

The toner powder image is transported by belt 10 to transfer station D. Transfer station D is located at a point of tangency on belt 10 as it moves around roller 14. A transfer roller 40 is disposed at transfer station D with the copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the remaining processing stations, the sheet feeding apparatus will be described briefly. With continued reference to FIG. 1, the sheet feeding apparatus includes a sheet transport 46 which advances, in seriatum, successive copy sheets from stack 48, or in lieu thereof, stack 50. The machine programming enables the operator to select the desired stack from which the copy sheet will be advanced. In this way, the selected copy sheet is advanced to transfer station D so that the toner powder image adhering to photoconductive surface of belt 10 may be transferred thereto.

After the toner powder image has been transferred to the copy sheet, conveyor 42 advances the copy sheet in the direction of arrow 44 to fixing station E. Fixing station E includes a fuser assembly, indicated generally by the reference numeral 52. Fuser assembly 52 comprises a heated fuser roll and a backup roll. The copy sheet having the toner powder image thereon, passes between the fuser roll and backup roll with the toner powder image contacting the fuser roll. This permanently affixes the toner powder image to the copy sheet. After fusing, conveyors 54 and 56 advance the copy sheet to finishing station F.

Returning now to the printing cycle, after the toner powder image has been transferred to the copy sheet at transfer station D, residual toner particles frequently remain adhering to belt 10. These residual toner particles are removed therefrom by a fibrous brush 58 coupled to a vacuum system. Brush 58 rotates so as to remove any residual particles remaining on the photoconductive surface of belt 10. These residual particles, in turn, are drawn through the vacuum system into a storage chamber.

Turning now to finishing station F, finishing station F includes an output tray 60 and a stapling apparatus 62. Only one stapling apparatus 62 is shown in FIG. 1, a plurality of such staplers may be employed wherein the stapler is manually adjustable to discrete positions corresponding to the paper sizes which may be employed in the printing machine. Either stapler or both staplers may be selected for stapling. Inasmuch as both staplers are identical to one another, only one stapler will be described hereinafter. Stapling apparatus 62 includes a modified stapler head 64 which corresponds to Model Number 62E manufactured by the Bostitch Corporation. Stapler head 64 is actuated by an electromagnetic device 66, such as a solenoid. Thus, actuation of solenoid 66 causes stapler head 64 to drive a staple through a stack of copy sheets 68. Clinching mechanism 70 bends the portion of the staple legs protruding through stack 68 into contact with the bottommost copy sheet thereof. After all of the staples have been clinched, the set of copy sheets is ready for removal by the machine operator from tray 60. Although only one output tray is depicted, a plurality of such output trays may be employed as well as a corresponding number of staplers associated therewith.

It is believed that the foregoing description is sufficient for purposes of the present application to illustrate the general operation of an electrophotographic printing machine incorporating the features of the present invention therein. Referring now to the specific subject matter of the present invention, FIG. 2 depicts the clinching mechanism employed in the FIG. 1 printing machine in detail.

Figure 2:
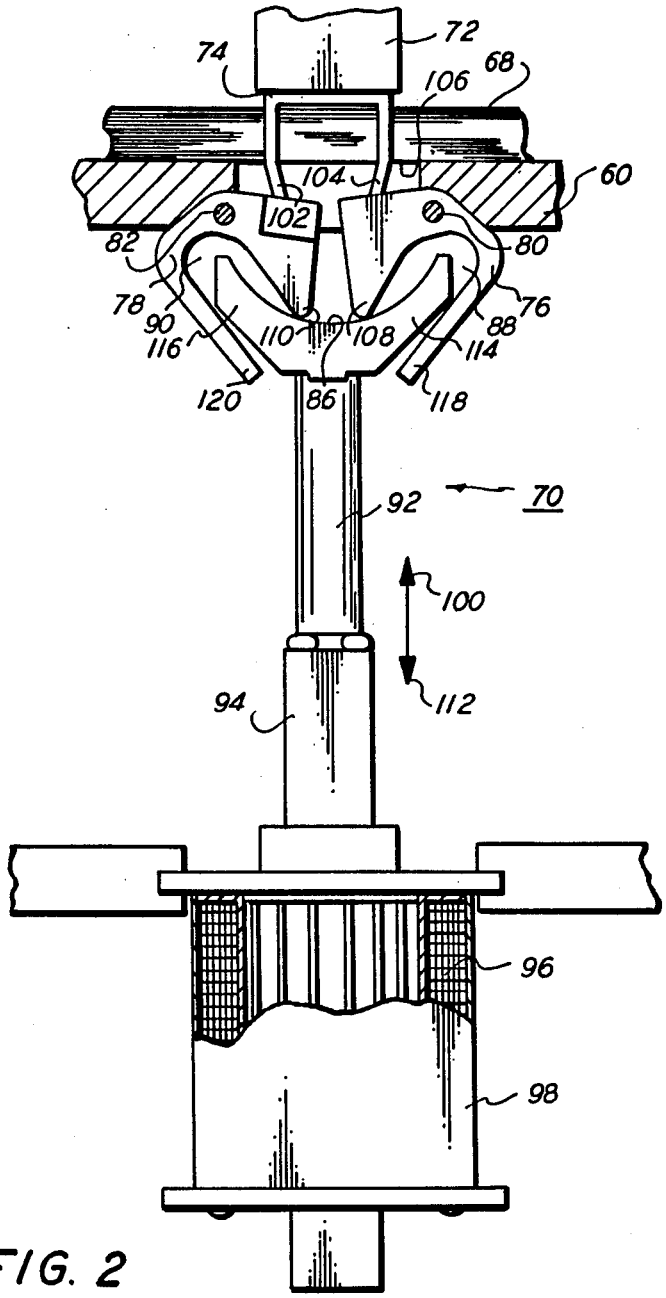
FIG. 2 is an elevational view showing the stapling apparatus employed in the FIG. 1 printing machine.

Turning now to FIG. 2, there is shown the detailed structure of clinching mechanism 70. As depicted thereat, driver 72 of stapler 64 has driven staple 74 through the stack of copy sheets 68 supported on tray 60. Clincher ears 76 and 78 are mounted rotatably on pins 80 and 82 secured to tray 60. In this way, clincher ears 76 and 78 are readily pivotable. Clinching rod 92 has an arcuate end portion 86. Arcuate end portion 86 of clinching rod 92 is concave and has a portion thereof disposed in slot 88 of ear 76 and the opposed portion thereof disposed in slot 90 of clinching ear 78. In order to accomodate arcuate portion 86 of clinching rod 92, slots 88 and 90 are open ended. The opposed end portion of clinching rod 92 is secured to solenoid armature 94. Energization of coil 96 of solenoid 98 causes armature 94 to move in the direction of arrow 100. A suitable solenoid is made by the Ledex Corporation of Dayton, Ohio, Model No. 6EC. As armature 94 moves in the direction of arrow 100, the armature, i.e. core, air gap decreases. Initially, armature 94 is fully extended, i.e. the core air gap is a maximum and the armature force a minimum. Energization of coil 96 causes armature 94 to move in the direction of arrow 100 decreasing the core air gap and increasing the force applied by armature 94. Thus, as the external displacement of armature 94 increases, the core air gap decreases. In this way, the force applied by armature 94 is directly proportional to the increase in external displacement of armature 94 in the direction of arrow 100 and inversely proportional to the decrease in core air gap. Moreover, the increase in external displacement equals the decrease in the air gap as armature 94 moves in the direction of arrow 100. Thus, armature 94 applies a force to clinching rod 92. As clinching rod 92 advances, it, in turn, pivots clinching ears 76 and 78 which bend staple legs 102 and 104 into engagement with the lowermost sheet 106 of stack 68. Preferably, the concave portion 86 of clinching rod 92 is crescent shaped being greater than a 40° elliptical shape. However, one skilled in the art will appreciate that any smooth elliptical shape is most likely satisfactory. The exact dimensions and curvature of concave portion 86 of clinching rod 92 depends upon the force characteristics of solenoid 98. However, by selecting an appropriate elliptical configuration for arcuate portion 86, the force versus displacement curves exerted on staple legs 102 and 104 will be substantially the same as the force versus displacement curve of solenoid 98. The crescent shape 86 of clinching rod 92 is any smooth elliptical shape greater than 40°. One skilled in the art will appreciate that crescent shape 86 may be made by using a numerically controlled milling machine, or by a ball mill having the diameter of the ellipse and being tipped at a 40° or greater angle in a milling machine with rod 92 moving therepast to form the elliptically shaped trough of crescent shape 86. It should be noted that portions 108 and 110 of ears 76 and 78, respectively, engage arcuate portion 86 of clinching rod 92 when clinching rod 92 moves in the direction of arrow 100.

Contrawise, when solenoid 98 is de-energized, clinching rod 92 moves in the direction of arrow 112. As clinching rod 92 moves in the direction of arrow 112, tapered portions 114 and 116 engage surfaces 118 and 120 of clinching ears 76 and 78, respectively. This pivots clinching ears 76 and 78 away from stapler legs 102 and 104 returning them to the inoperative positions spaced therefrom. Furthermore, as rod 92 moves in the direction of arrow 112, armature 94 also moves in the direction of arrow 112. Movement of armature 94 in the direction of arrow 112 decreases the external displacement thereof and increases the armature, i.e. core, air gap. When clinching ears 76 and 78 have returned to the inoperative position, armature 94 has returned to its initial position, i.e. where the external displacement is zero and the armature is fully extended, i.e. the core air gap is a maximum.

By way of example, solenoid coil 96 comprises a winding having an aperture therein in which armature 94 is mounted slideably. Armature 94 is made from a magnetic material to form a magnetic path in association with coil 96. Solenoid 98 is energized by applying an electrical current to coil 96.

Figure 3:
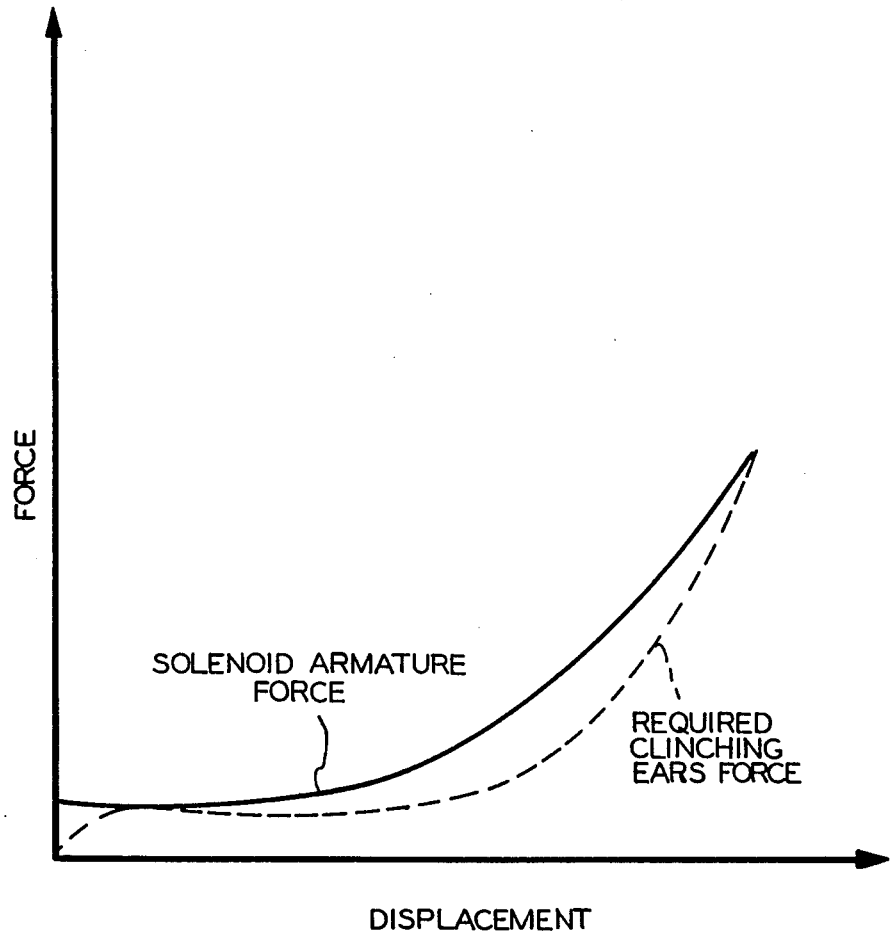
FIG. 3 is a graph depicting the force applied on the clinching mechanism and the force required as a function of displacement.

Referring now to FIG. 3, there is shown a curve depicting the output force versus the external displacement of armature 94. Similarly, the force exerted by clinching ears 78 and 80 required to clinch staple legs 102 and 104 is also shown. It is evident that these force versus displacement curves both are substantially identical to one another with the armature force being greater so that the applied force is greater than the required staple bending force. This force versus displacement match is achieved by utilizing a clinching rod having a concave driving surface for pivoting the clinching ears during the bending of the staple legs.

The force required to bend the staple legs is the component of the force normal to the staple legs. The bending force varies as the staple leg deflects. The bending force is one component of the axial force exerted by the solenoid armature. As the staple leg bends, the angle that the staple leg makes with respect to the axial centerline of the solenoid armature or armature force varies. The component force applied normal to the staple leg is a function of the elliptical shape of the clinching rod. By defining the elliptical configuration of the clinching rod, the force required by the clinching ears to bend the staple legs may be made to vary as a function of armature displacement in a manner substantially identical to the maximum output force that the solenoid armature is capable of applying as a function of armature external displacement.

In recapitulation, the force versus displacement curve of the solenoid is substantially identical to the required clinching force. The foregoing is achieved by utilizing a clinching rod having an arcuate driving surface in engagement with the clinching ears for the bending of the staple legs into engagement with the lowermost sheet of the stack.

It is, therefore, evident that there has been provided, in accordance with the present invention, a stapling apparatus having a clinching mechanism that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for stapling articles, including:

means for driving a staple through the articles so that a portion of the staple legs extend therethrough;

means for bending the portion of the staple legs protruding through the articles into substantial contact therewith so that the staple is clinched; and means for applying a force to said bending means which varies as the function of the distance said applying means translates, said bending means exerting a clinching force on the legs of the staple which varies as a function of the distance said applying means translates in substantially the same manner as the force applied thereon by said applying means.

2. An apparatus as recited in claim 1, wherein said applying means includes an electromagnetic power device operatively associated with said bending means so that said bending means clinches the staple in response to said electromagnetic power device being actuated.

3. An apparatus as recited in claim 2, wherein said electromagnetic power device includes:

a solenoid coil have an aperture therein; and a solenoid armature mounted slideably in the aperture of said coil for movement by said coil when said coil is energized, said bending means being interconnected with said armature and being arranged to move therewith so as to affect clinching of the staple.

4. An apparatus as recited in claim 3, wherein said bending means includes:

a pair of pivotably mounted spaced apart clinching ears; and a clinching rod having an arcuate end portion in contact with said clinching ears with the end portion opposed therefrom being coupled to said armature so that energization of said coil moves said armature and said rod in unison, said rod moving so that the arcuate end portion thereof pivots said clinching ears from an initial position remote from the staple legs protruding through the articles to a position in engagement therewith for clinching the staple with a force that varies as a function of displacement in substantially the same manner as the force applied thereon by said armature.

5. An apparatus as recited in claim 4, wherein the arcuate portion of said clinching rod is concave.

6. An apparatus as recited in claim 5, wherein said clinching ears include open ended slots with the concave end portion of said rod being positioned in the slots of said clinching ears so that when said clinching rod moves in one direction said clinching ears pivot from the initial position to the clinching position and when said rod moves in the opposed direction said clinching ears pivot from the clinching position to the initial position.

7. A reproducing machine of the type producing sets of stapled copies from a set of original documents, successive original documents advancing, in seriatim, from a supply source to an exposure platen for reproduction and then returning to the supply source in repeated cycles with the copies being stapled in sets and each set of copies corresponding to the set of original documents, wherein the improved stapling apparatus includes:

means for driving a staple through the set of copies so that a portion of the staple legs extends therethrough;

means for bending the portion of the staple legs protruding through the set of copies into substantial contact therewith so that the staple is clinched; and means for applying a force to said bending means which varies as a function of the distance said applying means translates, said bending means exerting a clinching force on the legs of the staple which varies as a function of the distance said applying means translates in substantially the same manner as the force applied thereon by said applying means.

8. A reproducing machine as recited in claim 7, wherein said applying means includes an electromagnetic power device operatively associated with said bending means so that said bending means clinches the staple in response to said electromagnetic power device being actuated.

9. A reproducing machine as recited in claim 8, wherein said electromagnetic power device includes:

a solenoid coil having an aperture therein; and a solenoid armature mounted slideably in the aperture of said coil for movement by said coil when said coil is energized, said bending means being interconnected with said armature and being arranged to move therewith so as to affect clinching of the staple.

10. A reproducing machine as recited in claim 9, wherein said bending means includes:

a pair of pivotably mounted spaced apart clinching ears; and a clinching rod having an arcuate end portion in contact with said clinching ears with the end portion opposed therefrom being coupled to said armature so that energization of said coil moves said armature and said rod in unison, said rod moving so that the arcuate end portion thereof pivots said ears from an initial position remote from the staple legs protruding through the set of copies to a position in engagement therewith for clinching the staple with a force that varies as the function of displacement in substantially the same manner as the force applied thereon by said armature.

11. A reproducing machine as recited in claim 10, wherein the arcuate portion of said clinching rod is concabe.

12. A reproducing machine as recited in claim 11, wherein said clinching ears include open ended slots with the concave end portion of said rod being positioned in the slots of said clinching ears so that when said clinching rod moves in one direction said clinching ears pivot from the initial position to the clinching position and when said rod moves in the opposed direction said clinching ears pivot from the clinching position to the initial position.

* * * * *